US008308010B2

(12) United States Patent
Letica et al.

(10) Patent No.: US 8,308,010 B2
(45) Date of Patent: Nov. 13, 2012

(54) TAMPER EVIDENT, CHILD RESISTANT CONTAINER

(75) Inventors: Anton Letica, Bloomfield Hills, MI (US); Arthur W. Habitz, Berkley, MI (US); John R. Selina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 182 days.

(21) Appl. No.: 12/961,662

(22) Filed: Dec. 7, 2010

(65) Prior Publication Data

US 2012/0138562 A1 Jun. 7, 2012

(51) Int. Cl.
*B65D 41/06* (2006.01)
*B65D 41/36* (2006.01)
*B65D 55/02* (2006.01)

(52) U.S. Cl. ..... 220/293; 220/266; 220/298; 220/301; 215/216; 215/221; 215/222; 215/250

(58) Field of Classification Search ..... 220/266, 220/265, 288, 293, 298, 301; 215/221, 250, 215/203, 201, 216, 217, 253
See application file for complete search history.

(56) References Cited

U.S. PATENT DOCUMENTS

| | | | | | |
|---|---|---|---|---|---|
| 3,371,817 | A | | 3/1968 | Gasbarra | |
| 3,784,047 | A | | 1/1974 | Cooper | |
| 3,888,383 | A | | 6/1975 | Rowlands | |
| 3,979,003 | A | | 9/1976 | Allen | |
| 4,027,777 | A | | 6/1977 | Blanke, Jr. | |
| 4,049,148 | A | | 9/1977 | Suhr et al. | |
| 4,111,329 | A | | 9/1978 | Lampman | |
| 4,171,057 | A | * | 10/1979 | Gach | 215/211 |
| 4,256,474 | A | | 3/1981 | Berger, Jr. et al. | |
| 4,288,000 | A | | 9/1981 | Luker et al. | |
| 4,322,010 | A | | 3/1982 | Curry | |
| 4,333,580 | A | | 6/1982 | Sweigart, Jr. | |
| 4,705,163 | A | * | 11/1987 | James | 426/128 |
| 4,723,686 | A | | 2/1988 | Pennisi | |
| 5,072,850 | A | | 12/1991 | Gagnon et al. | |
| 5,078,288 | A | * | 1/1992 | Fuchs | 215/209 |
| 5,383,564 | A | * | 1/1995 | Hamilton et al. | 215/221 |
| 5,605,244 | A | | 2/1997 | Bradshaw | |
| 5,676,273 | A | | 10/1997 | Jonkers et al. | |
| 5,845,820 | A | | 12/1998 | Foster | |
| 5,992,671 | A | | 11/1999 | Wardani | |
| 6,021,917 | A | | 2/2000 | Lovell et al. | |
| 6,168,035 | B1 | | 1/2001 | McLelland | |
| 6,402,798 | B1 | * | 6/2002 | Kallsen et al. | 55/385.3 |
| 6,688,483 | B2 | | 2/2004 | Davis | |
| 6,851,569 | B2 | | 2/2005 | Conti et al. | |
| 7,210,593 | B2 | * | 5/2007 | Stull et al. | 215/252 |
| 2002/0088811 | A1 | | 7/2002 | Lu | |
| 2004/0200839 | A1 | * | 10/2004 | Conti | 220/288 |

* cited by examiner

*Primary Examiner* — Anthony Stashick
*Assistant Examiner* — Jennifer Castriotta
(74) *Attorney, Agent, or Firm* — Young Basile Hanlon & MacFarlane PC

(57) ABSTRACT

A molded plastic container/closure combination providing a tamper evident feature, a child resistant feature and a removal facilitation feature. The closure has radially extending bayonets extending from the outer skirt which fit into horizontal slots in a beam molded integrally with the sidewall of the container. Rotation of the closure in one direction brings the bayonets into the slots for locking purposes. Rotation in the opposite direction unlocks the closure and continued rotation lifts the closure relative to the container to facilitate removal. A resiliently mounted release tab must be depressed before unlocking rotation is permitted. A latch prevents depression of the release tab until anchors on the sides of the latch are fractured. Serrations acting between the tab and the bayonets provide an audible indication of rotation.

11 Claims, 5 Drawing Sheets

FIG. 6
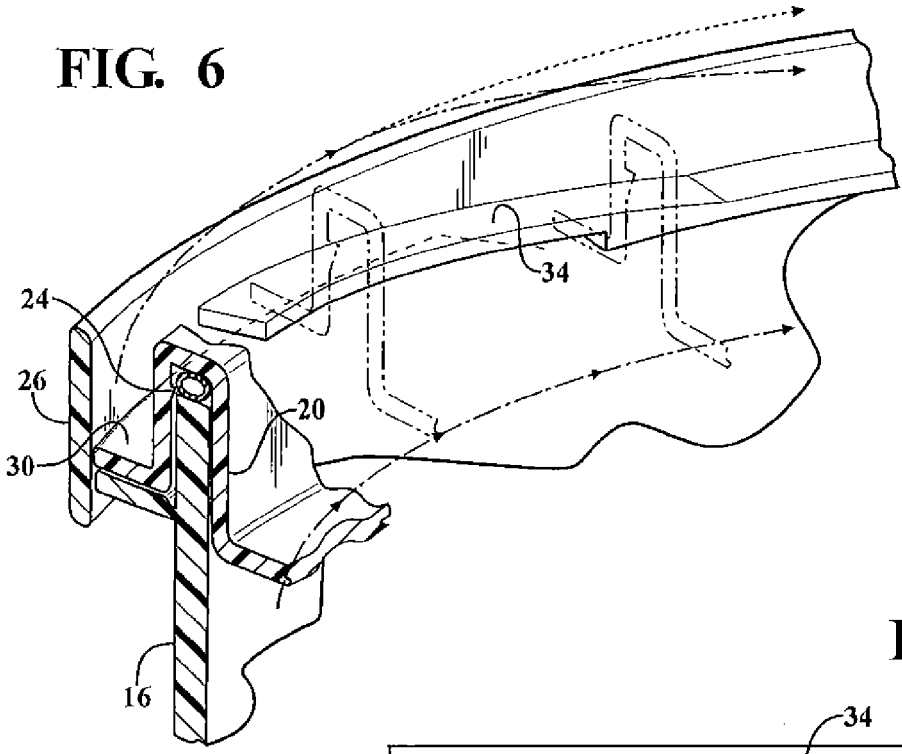
FIG. 7
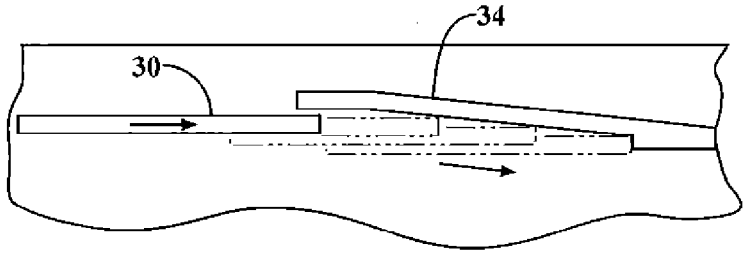
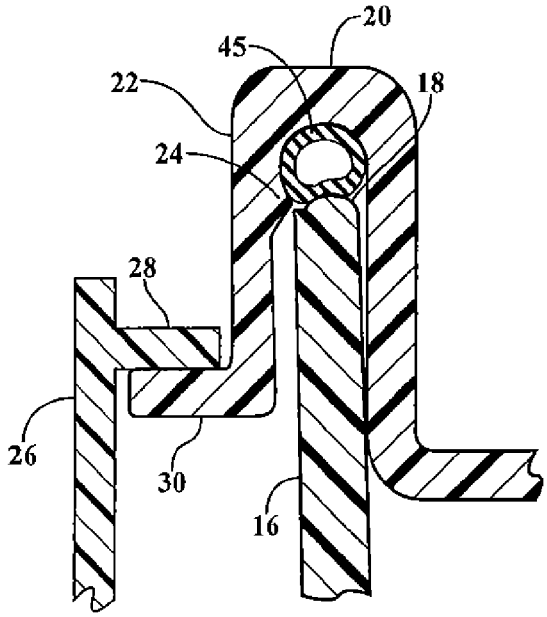
FIG. 8

TAMPER EVIDENT, CHILD RESISTANT CONTAINER

FIELD OF THE INVENTION

This invention relates to molded plastic container/closure combinations and more particularly to a container/closure combination having one or more of the following features:

(a) a tamper evident feature;

(b) a child resistant opening function; and (c) a feature which facilitates removal of the closure from the container.

BACKGROUND OF THE INVENTION

Molded plastic container/closure combinations are well known and used in a variety of sizes and configurations for a variety of purposes including the shipment and storage of various materials from food products to adhesives and laundry detergents. To prevent or at least indicate pilferage, it is common to incorporate a "tamper evident" feature into such combinations which provides a physical indication that the container may have been opened before reaching the end user. For example, the container and closure may be designed in such a way that it is necessary to remove a tear band before the closure can be removed.

Another feature incorporated into such containers is a complexity in the opening process which discourages or prevents opening by children; this is particularly important in the case of toxic products within the container.

BRIEF SUMMARY OF THE INVENTION

The present invention provides a molded plastic container/closure combination having one or more of the following features.

First, the container/closure combination can have a tamper evident feature to provide a physical indication in the event the container is opened prior to reaching the end user. As hereinafter described in greater detail, this feature is provided by forming a latch and release tab combination on the container which requires at least a partial fracture in the process of opening the container. The fracture is evident from visual inspection of the container and provides evidence of possible tampering. No tear band is required.

Secondly, the present invention can provide a child resistant feature which is achieved through the incorporation of mechanisms which complicate the opening process beyond the capabilities of most children. In general, this feature is achieved by providing a latch which must first be minimally displaced and a subsequent rotation of the closure relative to the container, which rotation is only permitted after the latch has been displaced. This complicated manipulation is relatively simple and straightforward for mature humans but, in part because it requires two hands and in part because it requires a coordinated combination of actions, is too complicated for most children.

Finally, the present invention can incorporate a closure removal facilitation feature which makes it easier with persons with limited manual dexterity to remove the closure from the container. In general, this is provided by means of an arrangement in which rotation of the closure in the opening direction causes the closure to lift somewhat relative to the container. This is achieved in the illustrative embodiment by a combination of closure bayonets and container-mounted ramps which direct the bayonets upwardly when the closure is rotated.

The various features and advantages of the present invention will be best understood from reading the following specification which describes an illustrative embodiment in detail. This description is to be taken in combination with the accompanying drawings.

BRIEF SUMMARY OF THE DRAWINGS

The description herein makes reference to the accompanying drawings wherein like reference numerals refer to like parts throughout the several views and wherein:

FIG. 6 is a perspective view partly in section showing the manner in which the closure coacts with the container during rotation;

FIG. 7 is a side view of a detail from FIG. 6;

FIG. 8 is another cross-sectional view showing the relationship between the container sidewall and the closure in a latched and locked condition;

DETAILED DESCRIPTION OF THE ILLUSTRATIVE EMBODIMENT

Figure 1:
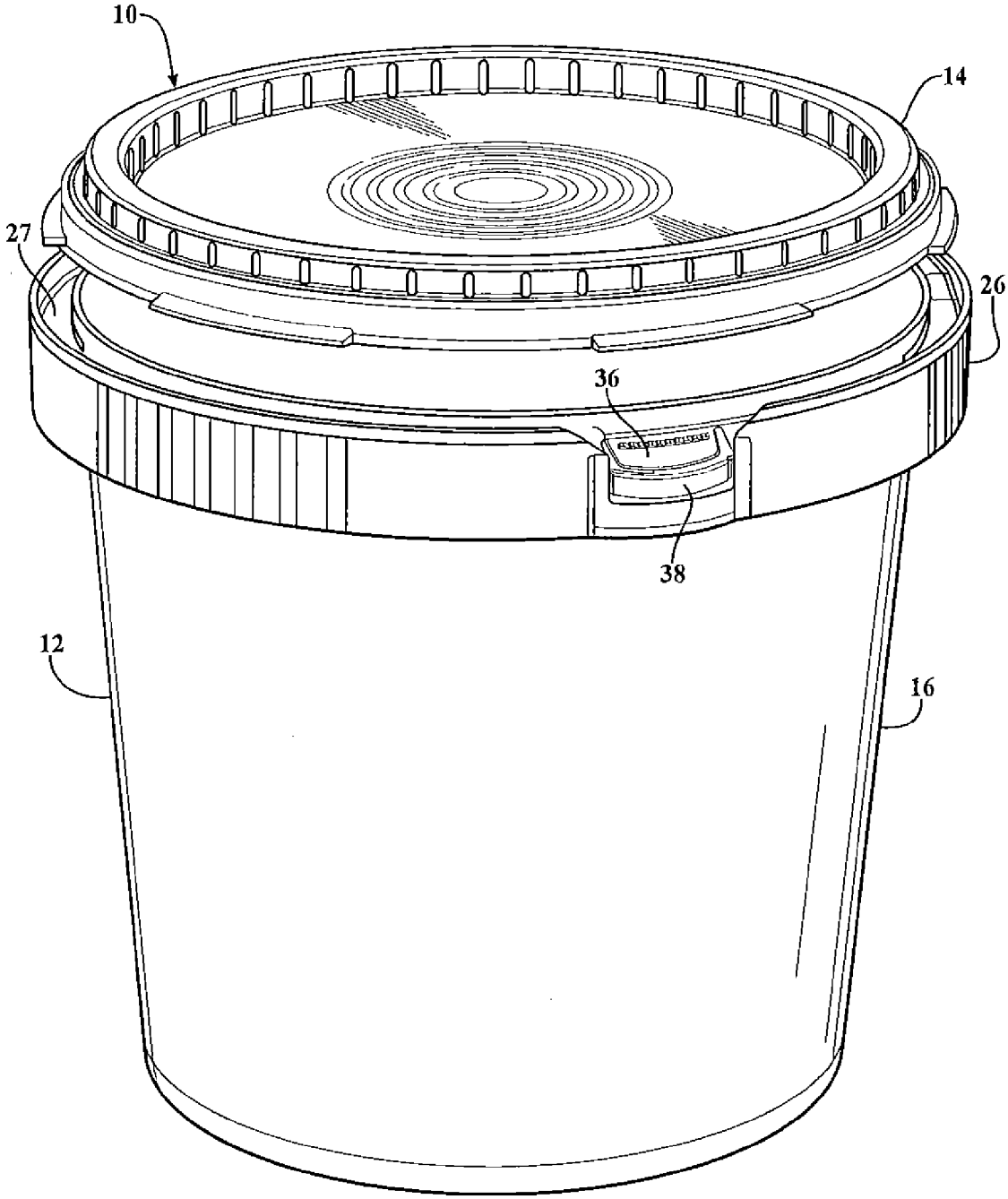
FIG. 1 is a perspective view of a container/closure combination molded in a suitable plastic such as high-density polyethylene and incorporating all features of the present invention.
Figure 2:
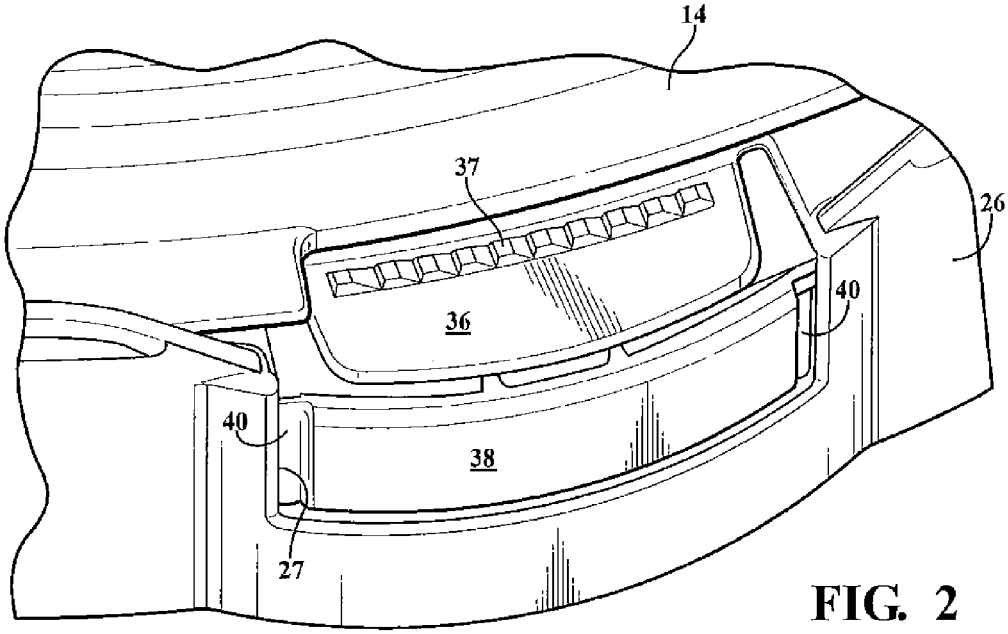
FIG. 2 is a perspective view of a latching detail involved in the closure removal function.

Referring to the figures, there is shown a molded plastic container/closure combination 10 comprising a five-gallon, open top, molded plastic container 12 and a molded plastic closure 14 which is adapted to be mated to the container 12 so as to close and seal the container. In accordance with the various features of the invention hereinafter described, there is provided a tamper evident feature, a child resistant feature and a removal facilitation feature. The container 12 and closure 14 are preferably manufactured by injection molding high-density polyethylene in appropriate molds as are well known to persons skilled in the molding arts. The invention is, however, not limited to HDPE as a material of construction as other materials may also be used. The five-gallon size is given only by way of example.

The container 12 has a tapered sidewall 16 which terminates at the upper end in a rim 18 which is received within an inverted U-shaped peripheral channel structure 20 on the closure 14. The closure 14 is molded with an inverted U-shaped peripheral channel which receives the top edge 18 of the container and includes a gasket 45 held in place by a small retainer rib 24. Closure 14 includes an annular outer skirt 22 with integrally molded and uniformly angularly spaced, radially outwardly extending bayonets 30 formed thereon. In this example, six bayonets 30 are used and they each define an included angle of slightly less than 30° with gaps of slightly more than 30° between the bayonets. More or fewer bayonets 30 may also be used in which case the included angles change.

The container 12 is molded integrally with a "beam" 26 which takes the form of an annular collar, the top of which is essentially coplanar with the top rim 18 of the container 12. The beam 26 is approximately 1 inch to 1¼ inches in vertical dimension and extends continuously around the container sidewall except for a gap 27, the purpose of which is hereinafter described.

The beam 26 stands radially off of the container sidewall 16 about ¼" or more by means of a rib 28 upon which the bayonets 30 are seated when the closure 14 is placed on the container 12 in such a way as to cause the skirt 22 to extend downwardly into the radial gap between the container sidewall 16 and the outer portion of the beam 26, as shown in FIGS. 3A, 3B, 6 and 9. The rib 28 is not flat all the way around the container; rather, it is interrupted by six elevated sections 34 which perform two functions: first, the elevated portion 34 define six horizontal and circumferential one-way slots into which the bayonets 30 may be rotated in one direction until they reach an end stop 36 to lock the closure 14 down to the container 12. The term "slot" does not here imply that the bayonets enter an area with both a top and bottom. Indeed, the rib is generally relieved under the elevated riser portions 34. Secondly, the elevated portions 34 form ramps on their exterior surfaces which the bayonets ride up on to lift the closure relative to the container 12 approximately ¼" when the closure is rotated approximately 60° in the opposite direction; i.e., twice as far as is necessary to unlock the closure relative to the container by bringing the bayonets 30 out from under the raised portions 34 of the rib 28 as previously described. The portions 34 also can function to cam the closure down onto the top of the container 12 when rotated in the locking direction thereby to improve the seal between container and closure. A gasket seal can be provided as shown. Alternatively, a vented, gasketless design can be used.

Figure 3A:
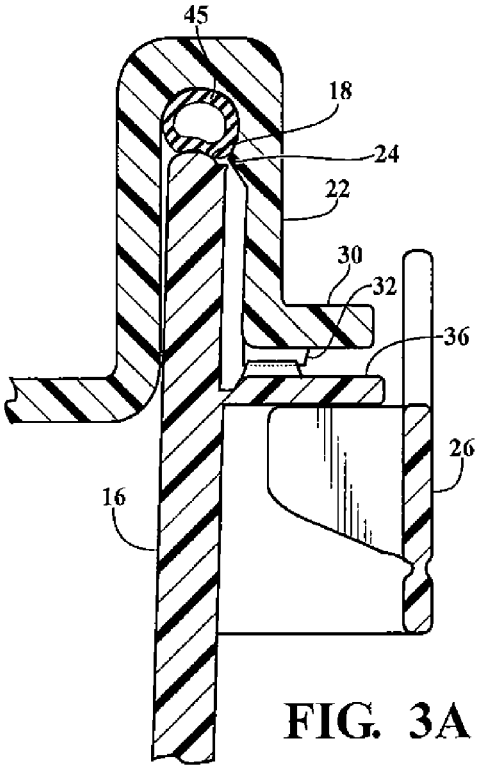
FIG. 3A is a sectional view through the closure and the container sidewall illustrating an audible rotation indicator function as well as a release function.
Figure 3B:
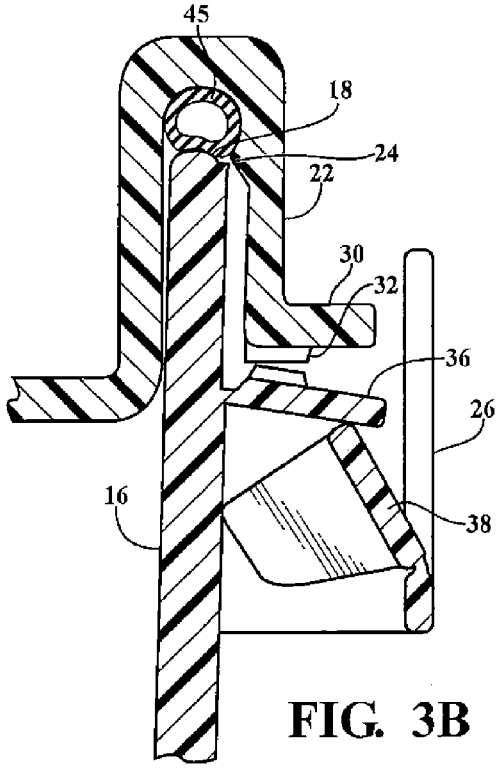
FIG. 3B is a sectional view of the same structure as shown in FIG. 3*a* but with the release tab in a deflected position.
Figure 4:
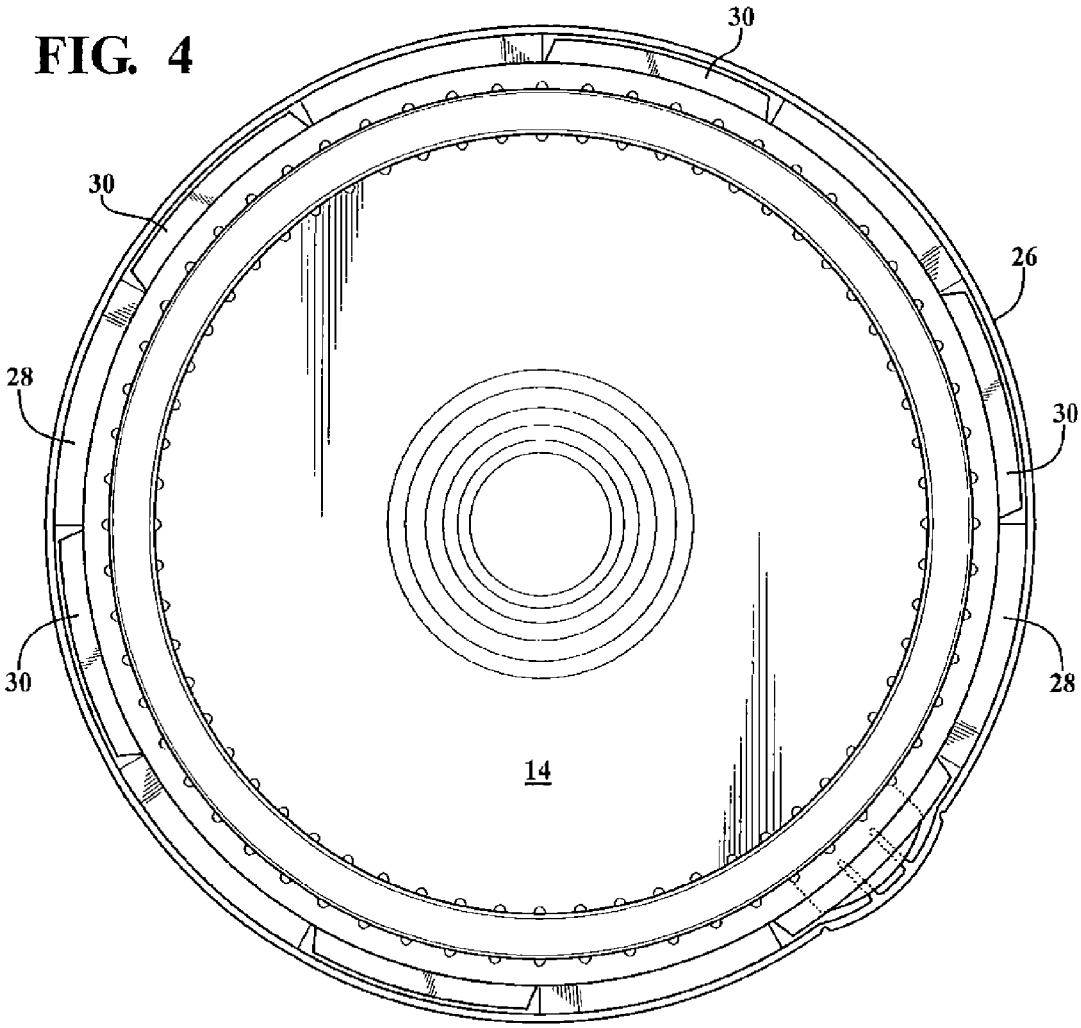
FIG. 4 is a top plan view of the structure of FIG. 1.
Figure 5:
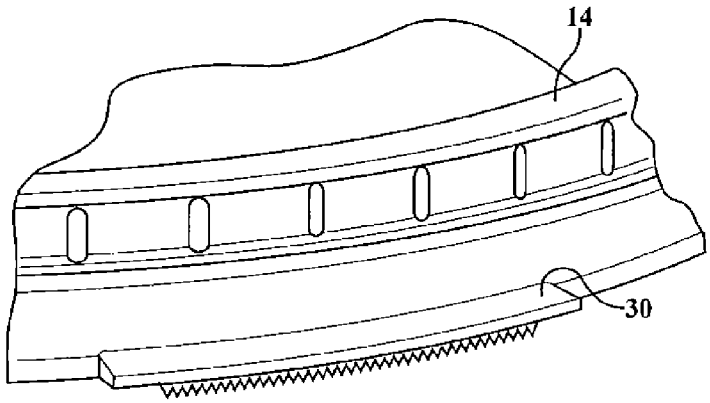
FIG. 5 is a perspective view of a detail of the closure.

As shown in FIGS. 3A and 3B, serrations 32 are formed on the bottom surfaces of the bayonets 30 to provide an audible indication of rotation relative to a container feature 36 hereinafter described.

As indicated above, the beam 26 is interrupted by a gap 27 within which is molded a release tab 36 having serrations 37 formed on the upper surface thereof The serrations 37 coact with the serrations 32 on the bottoms of the bayonets 30 to provide the audible indication of rotation when the release tab is in a position which permits rotation of the closure 14 relative to the container 12. The release tab 36 is hinged at its inner extremity to the container sidewall such that it may be resiliently depressed downwardly out of its normal position where it prevents rotation of the closure 14 by interfering contact with the edges of the bayonets 30, to a lowered position where it no longer interferes with the bayonets 30 and therefore permits rotation of the closure 14 relative to the container 12 for locking and unlocking purposes. In the lowered position, the release tab allows coaction between the serrations 32, 37 as shown in FIG. 3B.

To provide a tamper evident feature, an arcuate latch 38 conforming generally to the container/closure combination is molded into the container sidewall with a living bottom hinge 39 and frangible side anchors 40. The latch 38 is located so as to prevent downward depression of the release tab 36. However, the frangible anchors 40 are thin and can be relatively easily fractured by pressing inwardly on the latch 38 after which the tab 36 can be pressed down, by bending it around the hinge 39 as shown in FIG. 3B to a position where the release tab 36 no longer interferes with the bayonets and therefore allows rotation of the closure 14 relative to the container 12 to permit the opening manipulation.

Figure 9:
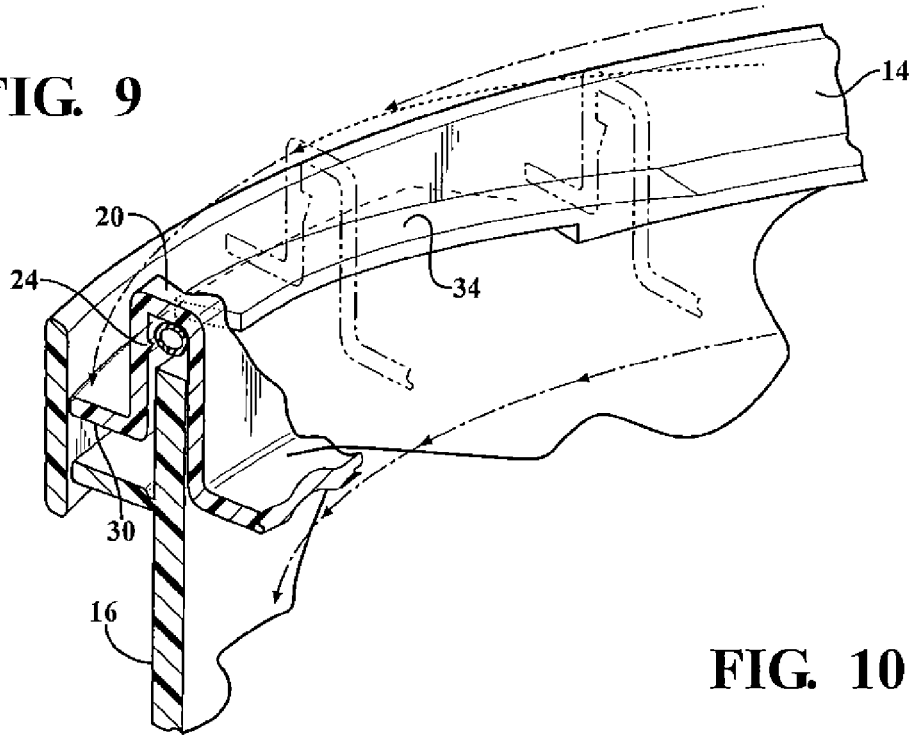
FIG. 9 is similar to FIG. 6 but illustrates how the closure rises relative to the container sidewall to facilitate removal.
Figure 10:
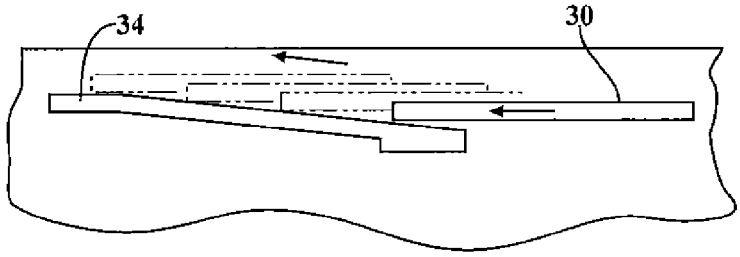
FIG. 10 is similar to FIG. 7 but indicates how the container and closure coact during removal rotation.
Figure 11:
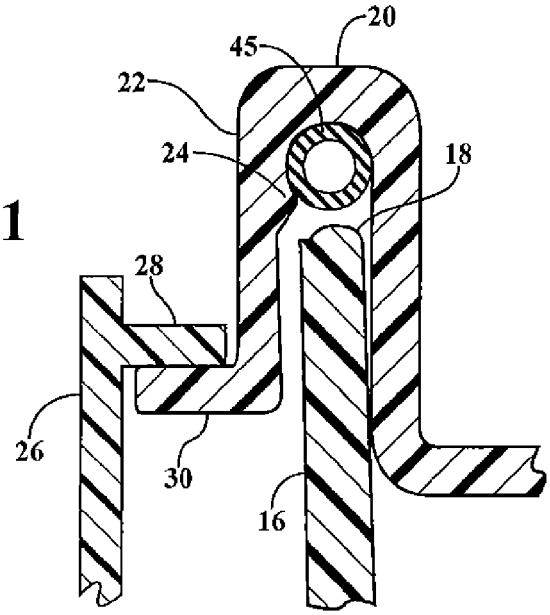
FIG. 11 is similar to FIG. 8 but indicates how the closure lifts relative to the container sidewall during a full removal process.

Summarizing, operation of the container/closure combination is essentially as follows: Once the container 12 is filled, the closure 14 is attached to the container 12 typically by machinery and the bayonets 30 are rotated into the horizontal slots provided by the riser portions 34 of the rib 28 until the release tab 36 is centered between bayonets 30, care being taken to prevent fracture of the anchors 40 on the sides of the latch 38. To remove the closure 14 from the container 12, one first depresses the latch 38 inwardly to fracture the anchors 40 until the release tab 36 may be pushed downwardly. With the release tab 36 deflected downwardly around its own living hinge, the closure 14 is rotated to bring the bayonets 30 out from under the raised portions 34 of the rib 28 until they are in the 30° clearance gaps between slots. At this point, the closure 14 may be removed by lifting it straight up, relative to the container 12. However, an additional assist feature is provided for the convenience of persons having limited manual dexterity through continued rotation of the closure 14 through another angle of rotation of approximately 30° thereby causing the bayonets to ride up on the ramps provided by the raised portions 34 thus lifting the closure 14 relative to the container 12 as best shown in FIGS. 9 through 11. Unlike a conventional screw thread, the risers 34 lift all bayonets at once and to the same degree until they sit atop the risers 34. Four features of the invention are thus provided:

(1) A tamper evident feature in the form of the fracturable anchors 40 which are broken to operate the latch 38;

(2) A child resistant feature which involves the combination of the latch 38 and the complex action required to depress the release tab 36 and rotate the closure 14 at the same time;

(3) A removal facilitation feature provided by ramps which coact with the bayonets 30 to lift the closure 14 relative to the container upon continued rotation of the closure 14 in the opening or unlocking direction. As indicated above, these features can be used individually as well as in combination; and (4) An audible indication of rotation.

The invention has been described with reference to an illustrative embodiment. Various changes in design, size and proportions are possible within the scope of the invention.

What is claimed is:

1. A tamper-evident container/closure combination comprising:

an open top molded plastic container having a top rim and an annular, radially set-off beam proximate said rim to define an annular groove;

a plurality of angularly spaced horizontal one-way locking slots uniformly arranged around and within the groove;

a molded plastic closure having a center portion surrounded by an annular rim having an outer skirt defining an inverted U-shaped channel which can be fit over said rim such that the skirt fits into said groove;

a plurality of angularly spaced, radially extending bayonets formed on said closure which can be rotated into said locking slots by turning the closure on the container, the spacing between said slots and the circumferential dimensions of said bayonets being such that the bayonets can be rotated out of said slots for removal of said closure from said container;

a release tab resiliently attached to said container and having a first position between said slots to interferingly prevent rotation of said closure and a second deflected position which allows rotation of said closure;

a latch proximate said tab to prevent said tab from being moved to said second deflected position; and at least one frangible connection formed between said latch and said container, said frangible connection exhibiting reduced structural strength to facilitate fracture thereof so that said latch can be at least partially removed to allow movement of said tab to said deflected position but to leave physical evidence of such at least partial removal.

2. The combination defined in claim 1 wherein said latch takes the form of a curved panel having frangible connections to the container sidewall on circumferentially opposite ends thereof.

3. The combination defined in claim 1 wherein said set-off is formed by a radially extending rib integral with container sidewall and said slots are formed by a radially extending second rib above said radially extending rib, said second ribs having interior stops which limit rotation of said closure relative to said container.

4. The combination defined in claim 3 wherein said stops are coextensive with exterior ramps joining the second ribs to said ribs, said ramps functioning as cams in cooperation with said bayonets to cause lifting of said closure relative to said container upon rotation of said closure in the unlocking direction.

5. The combination defined in claim 1 wherein said container and said closure are both made of high density polyethylene.

6. The combination defined in claim 1 further comprising a plurality of surface irregularities formed on a surface of said bayonets to provide an audible indication of rotation of said closure.

7. The combination of claim 1 wherein said release tab is formed integrally with said container and joined to said container by means of a hinge.

8. A container/closure combination comprising:

an open top molded plastic container having a top rim and an annular radially set-off beam proximate said rim to define an upwardly opening annular groove between the container sidewall and the beam;

a plurality of angularly spaced horizontal locking slots arranged around and within the groove;

a molded plastic closure having a center portion surrounded by an annular rim having an outer skirt which fits into said groove;

a plurality of angularly spaced, radially extending bayonets formed on said closure which can be rotated into said locking slots by turning the closure on the container, the spacing between said slots and the circumferential dimensions of said bayonets being such that the bayonets can be rotated out of said slots for removal of said closure from said container; and a release tab resiliently attached to and formed integrally with said container and having a first position between said slots to interferingly prevent rotation of said closure and a second deflected position which allows rotation of said closure.

9. A combination defined in claim 8 further comprising a latch formed integrally with said container and positioned to prevent said release tab from being moved to said second deflected position.

10. The combination defined in claim 8 further comprising a frangible connection between said latch and said container.

11. A container/closure combination comprising:

an open-top, molded plastic container having a sidewall which terminates in a top rim and a beam proximate the top rim which is radially outwardly spaced from the container sidewall to define a gap;

a molded plastic closure having a peripheral skirt which fits into said gap and bayonets extending outwardly from said skirt; and means within said gap for coacting with said bayonets for locking the closure to the container when the closure is rotated in one direction and for lifting the closure by a defined movement relative to the closure when the closure is rotated in the opposite direction.

* * * * *